US005400056A

United States Patent [19]

Colles

[11] Patent Number: 5,400,056

[45] Date of Patent: Mar. 21, 1995

[54] APPARATUS FOR AND METHOD OF PROCESSING AND CONVERTING BINARY INFORMATION TO CORRESPONDING ANALOG SIGNALS

[75] Inventor: Joseph H. Colles, Bonsall, Calif.

[73] Assignee: Brooktree Corporation, San Diego, Calif.

[21] Appl. No.: 6,813

[22] Filed: Jan. 21, 1993

[51] Int. Cl.[6] ..... G09G 1/28

[52] U.S. Cl. ..... 345/199; 345/153

[58] Field of Search ..... 340/703, 701, 799, 750, 340/721, 723, 724; 345/153, 155, 154, 150, 186, 187, 188, 199, 203

[56] References Cited

U.S. PATENT DOCUMENTS

| | | | |
|---|---|---|---|
| 4,484,187 | 11/1984 | Brown et al. | 340/750 |
| 4,684,942 | 8/1987 | Nishi et al. | 340/703 |
| 4,789,854 | 12/1988 | Ishi | 340/703 |
| 4,799,053 | 1/1989 | Van Aken et al. | 340/703 |
| 4,808,989 | 2/1989 | Tabata et al. | 340/703 |
| 4,845,488 | 7/1989 | Kelly | 340/703 |
| 4,931,785 | 6/1990 | Ishi | 340/703 |
| 5,181,014 | 1/1993 | Dalrymple et al. | 340/799 |

*Primary Examiner*—Alvin E. Oberley
*Assistant Examiner*—Xiao M. Wu
*Attorney, Agent, or Firm*—Ellsworth R. Roston; Charles H. Schwartz

[57] ABSTRACT

In first and second modes, successive pairs of bytes, each with a suitable number (e.g. 8) of binary indications, are respectively processed in each clock cycle or clock half cycle to provide a true color. In these modes, the successive pairs of bytes may be processed in a 5,5,5, or a 5,6,5 pattern representing the primary colors for a pixel. In a third mode, the bytes may be introduced to a memory having a plurality of positions for storing individual binary combinations, which may be updated by a microprocessor, representing pseudo colors. In the third mode, a particular position in the memory is selected in accordance with the indications in each byte in each clock cycle or half cycle. In an additional mode, three successive bytes in a group may indicate the primary colors defining a true color when the fourth byte in the group provides a particular indication (e.g. 0 for all 8 binary bits). In this mode, indications in the fourth byte other than the particular indication select a particular position in the memory to represent a pseudo color. In this mode, the successive bytes may be respectively provided either in each clock cycle or clock half cycle. The binary indications representing the true color or the pseudo color in the different modes are converted to analog signals for introduction to a video monitor. In the additional mode, the indications in particular positions in the memory may be blocked from conversion to analog signals.

26 Claims, 5 Drawing Sheets

32

| A7 | A6 | A5 | A4 | |
|---|---|---|---|---|
| 0 | 0 | 0 | 0 | PSEUDO COLOR (256 COLORS) |
| 1 | 0 | 0 | 0 | 5:5:5 DUAL-EDGE CLOCK (33K COLORS) |
| 1 | 1 | 0 | 0 | 5:6:5 DUAL-EDGE CLOCK (65K COLORS) |
| 1 | 0 | 1 | 0 | 5:5:5 SINGLE-EDGE CLOCK (33K COLORS) |
| 1 | 1 | 1 | 0 | 5:6:5 SINGLE-EDGE CLOCK (65K COLORS) |
| 1 | 0 | 0 | 1 | 8:8:8 OL DUAL-EDGE CLOCK (16.8M COLORS) |
| 1 | 0 | 1 | 1 | 8:8:8 OL SINGLE-EDGE CLOCK (16.8M COLORS) |
| 1 | 1 | 1 | 1 | 8:8:8 SINGLE-EDGE CLOCK |

APPARATUS FOR AND METHOD OF PROCESSING AND CONVERTING BINARY INFORMATION TO CORRESPONDING ANALOG SIGNALS

This invention relates to apparatus for, and methods of, providing binary indications representing primary colors and for converting the binary indications to analog signals for display on a video monitor at successive pixel positions in the video monitor.

In many applications such as in work stations or personal computers, information representing the colors at the different pixel positions in a video monitor is stored in binary form in a display memory. The information stored in the successive positions in the display memory is retrieved sequentially from the display memory and is converted to analog signals representing the primary colors. The primary colors represented by such analog signals are then displayed at the different pixel positions on the video monitor.

Until relatively recently, a separate memory (or a look up table) was provided in the work station or personal computer to introduce binary indications of selective primary colors to the analog converter. Each position in the memory stored the binary indications of the primary colors for an individual color different from the composite colors represented by the binary indications stored at the other positions in the memory. The display memory provided indications at each pixel position of the particular position to be selected in the lookup table. When a position in the lookup table was selected in accordance with the indications in the display memory, the binary indications at this position were converted to analog signals for introduction to the video monitor. Since the lookup table had only a limited number of positions, the color indications at the different pixel positions on the video monitor represented only pseudo colors of the true colors in the image.

In recent years, work stations and personal computers have provided at times true colors, rather than pseudo colors, at the different positions on the video monitor. At such times, the binary indications from the display memory have been introduced directly to the analog converters for the production of signals which are introduced to the video monitor to provide the color representations at the different pixel positions on the video monitor. In these work stations and personal computers, a register is provided for the production at first times in a first state of the register of pseudo colors as specified in the previous paragraph or for the production at other times in the second state of the register of real colors as specified in this paragraph.

When true colors have been displayed in recent years at the different positions on the video monitor, the work stations and personal computers have operated to convert successive pairs of bytes, each formed from eight (8) binary indications, into binary indications of the three (3) primary colors (e.g. red, green and blue) in a pattern of 5,5, and 5 binary bits or in a pattern of 5,6 and 5 binary bits where the numerals "5" and "6" represent the number of binary bits for individual ones of the primary colors.

The patterns of 5,5 and 5 and of 5,6 and 5 binary bits are provided in accordance with different patterns of settings of a plurality of registers. In accordance with other settings in a register, successive bytes of eight (8) binary indications may be presented either in successive cycles of a clock signal or in successive half cycles of the clock signal to obtain the indications of the true colors.

Other enhancements have been provided in recent years in the color images displayed on the video monitors in work stations and personal computers. For example, windows have been incorporated into color images at selected positions in the color images. By providing these windows, a first image can be displayed on much of the face of the video monitor while other images are simultaneously displayed in the different windows. For example, a map of the United States may be displayed on a video monitor while enlarged maps of Los Angeles, Chicago and New York may be simultaneously displayed on the video monitor at positions adjacent their locations on the map of the United States.

As will be seen, the number of different patterns of color information has been considerably expanded in recent years. For example, color images may be presented on a video monitor either in true color or in pseudo color, either in a 5,5 and 5 presentation of binary bits or in a 5,6 and 5 presentation of binary bits and either in successive cycles of a clock signal or successive half cycles of the clock signal. However, significant limitations still exist in the different patterns in which color information may be presented at the different pixel positions on a color monitor. For example, the different patterns of color information now provided in work stations and personal computers do not allow color information to be provided in real colors for much of a color image on a video monitor and to be provided in pseudo colors in a window of such color image or to be provided in pseudo colors on much of the color image and in real colors in windows in the image. The desire for this interchangeability between real and pseudo color in a single frame of the color image on a video monitor has been known and appreciated for some time. However, in spite of much effort to offer this enhanced capability, this enhanced capability has not been able to be provided.

This invention provides a system which includes all of the different patterns of color information previously provided in work stations and personal computers. For example, color images may be presented on a video monitor either in true color or pseudocolor, the true color to be either in a 5,5,5 or in a 5,6,5 presentation and either in successive cycles or in successive half cycles of a clock signal. The system of this invention also offers other patterns of color information not previously found in the prior art. For example, the system of this invention provides color information in an 8,8 and 8 pattern of binary indications for the three primary colors to produce true colors in an image on a video monitor. The 8, 8 and 8 pattern of binary indications may be provided either in successive cycles or successive half cycles of the clock signals. The color information of 8,8 and 8 bytes in the system of this invention is provided in a pattern of three (3) bytes in a group in which a fourth (4th) byte in the group controls the presentation of information either as true colors or pseudo colors.

When the fourth (4th) byte of binary indications in a group has a particular pattern such as a binary value of "0" for each of the eight (8) binary indications in such byte, the three (3) other bytes in the group are processed to provide a true color. When the fourth (4th) byte in a group has an analog value different from "0", the indications in the fourth (4th) byte are processed to select a particular position in a memory and the other three (3) bytes are disregarded. This particular position in the memory provides an indication of a particular pseudo random color.

The patterns for the different groups of bytes in a frame of the color image on the video monitor may be preselected to provide true colors for much of the color image and pseudo random colors for a window in the color image or vice versa. In this way, two (2) different pictures may be provided simultaneously on video monitor, one in true colors and the other in a window in pseudo colors.

In first and second modes in one embodiment of the invention, successive pairs of bytes, each with a suitable number (e.g. 8) of binary indications, are respectively processed in each clock cycle or clock half cycle to provide a true color. In these modes, the successive pairs of bytes may be processed in a 5,5,5, or a 5,6,5 pattern representing the primary colors for a pixel.

In a third mode, the bytes may be introduced to a memory having a plurality of positions for storing individual binary combinations, which may be updated by a microprocessor, representing pseudo colors. In the third mode, a particular position in the memory is selected in accordance with the indications in each byte in each clock cycle or clock half cycle.

In an additional mode, three successive bytes in a group may indicate the primary colors defining a true color when the fourth byte in the group provides a particular indication (e.g. 0 for all 8 binary bits). In this mode, indications in the fourth byte other than the particular indication select a particular position in the memory to represent a pseudo color. In this mode, the successive bytes may be respectively provided either in each clock cycle or clock half cycle. In a still further mode providing true colors, three (3) successive bytes, each of eight (8) bits, may represent the three (3) primary colors red, green and blue.

The binary indications representing the true color or the pseudo color in the different modes are converted to analog signals for introduction to a video monitor. In the additional mode, the indications in particular positions in the memory may be blocked from conversion to analog signals.

Figure 8:
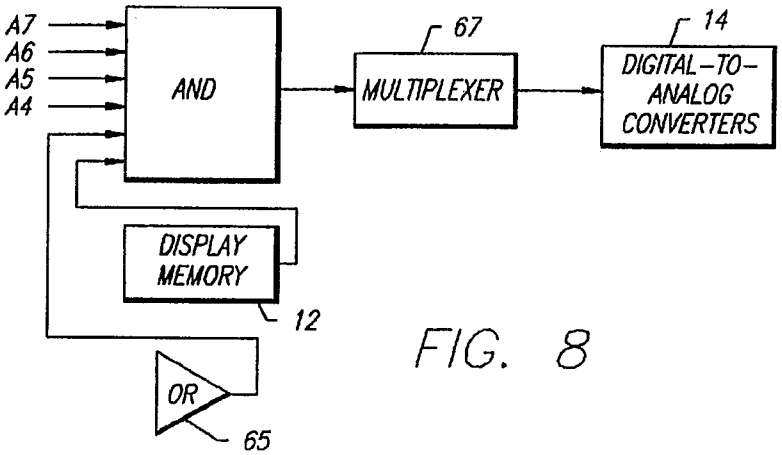
Figure 4A:
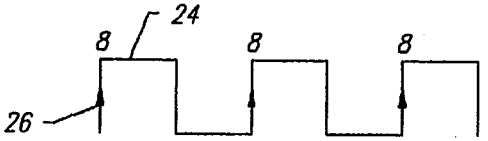
Figure 4B:
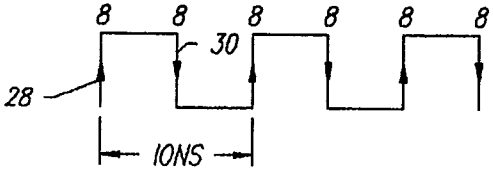
Figures 3, 7:
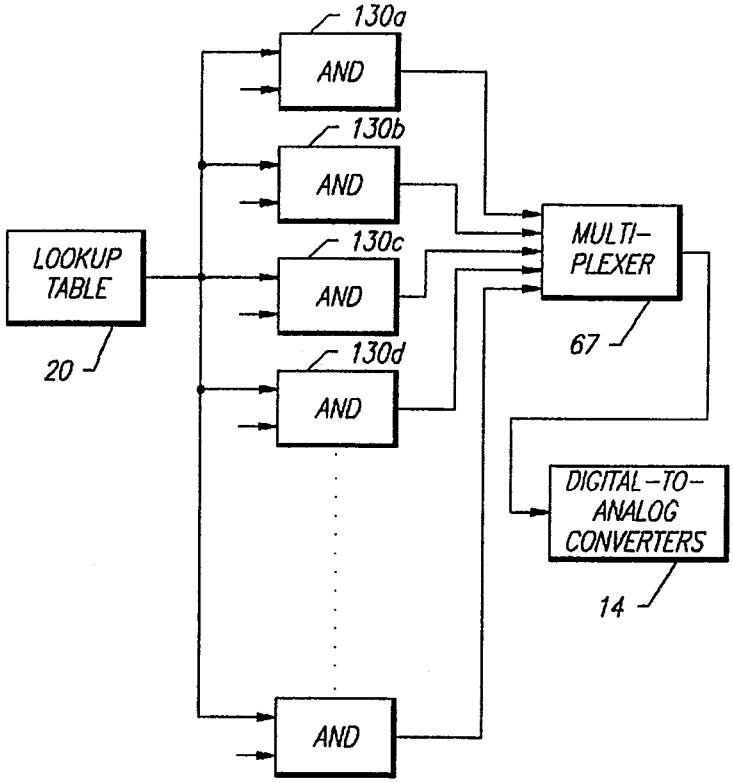
FIG. 3 is a chart showing the different combinations of signals in a plurality of registers for controlling the production of individual modes of operation of the system of this invention in providing color images on a video monitor.
Figure 5A:
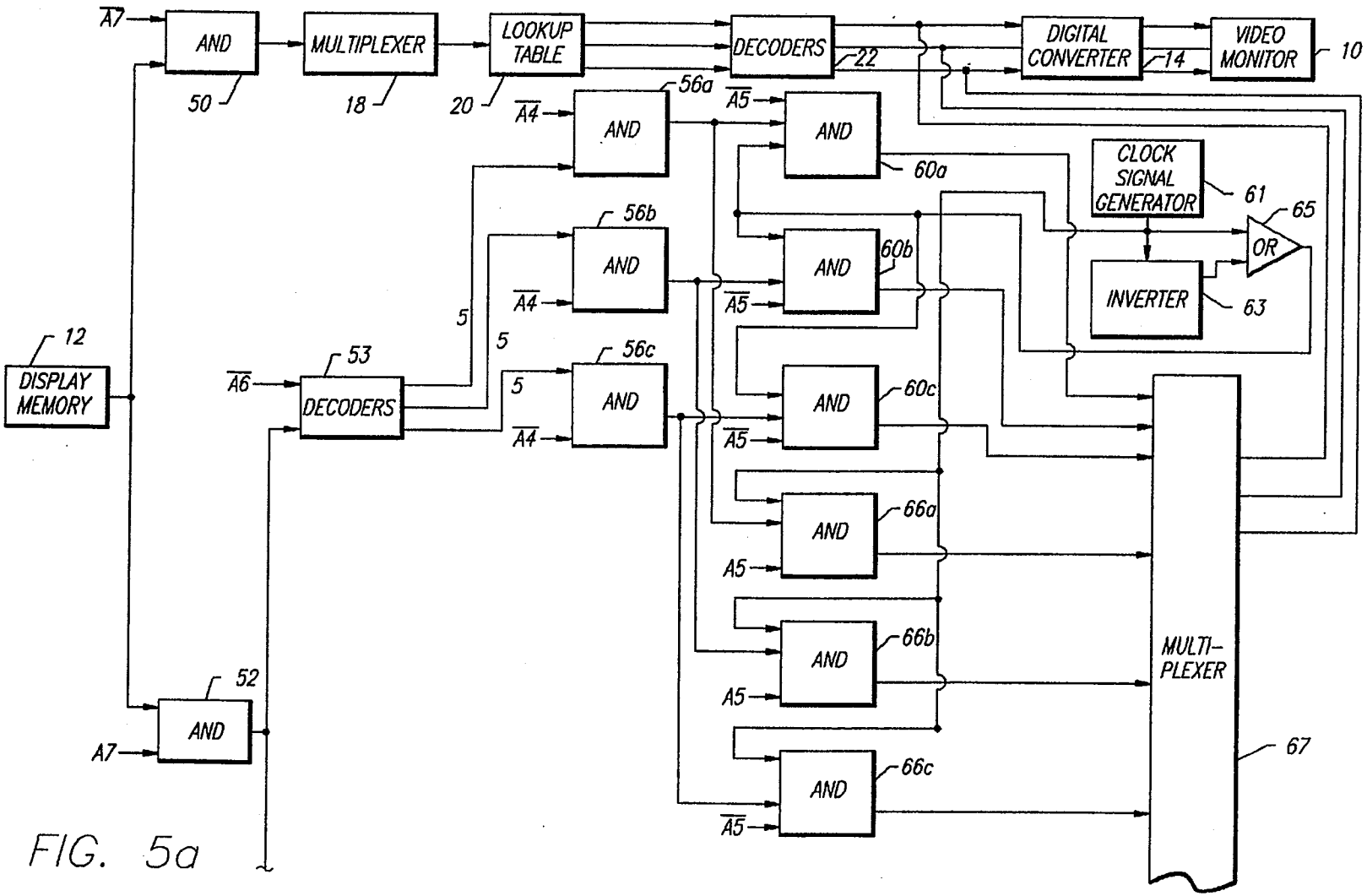
Figure 5B:
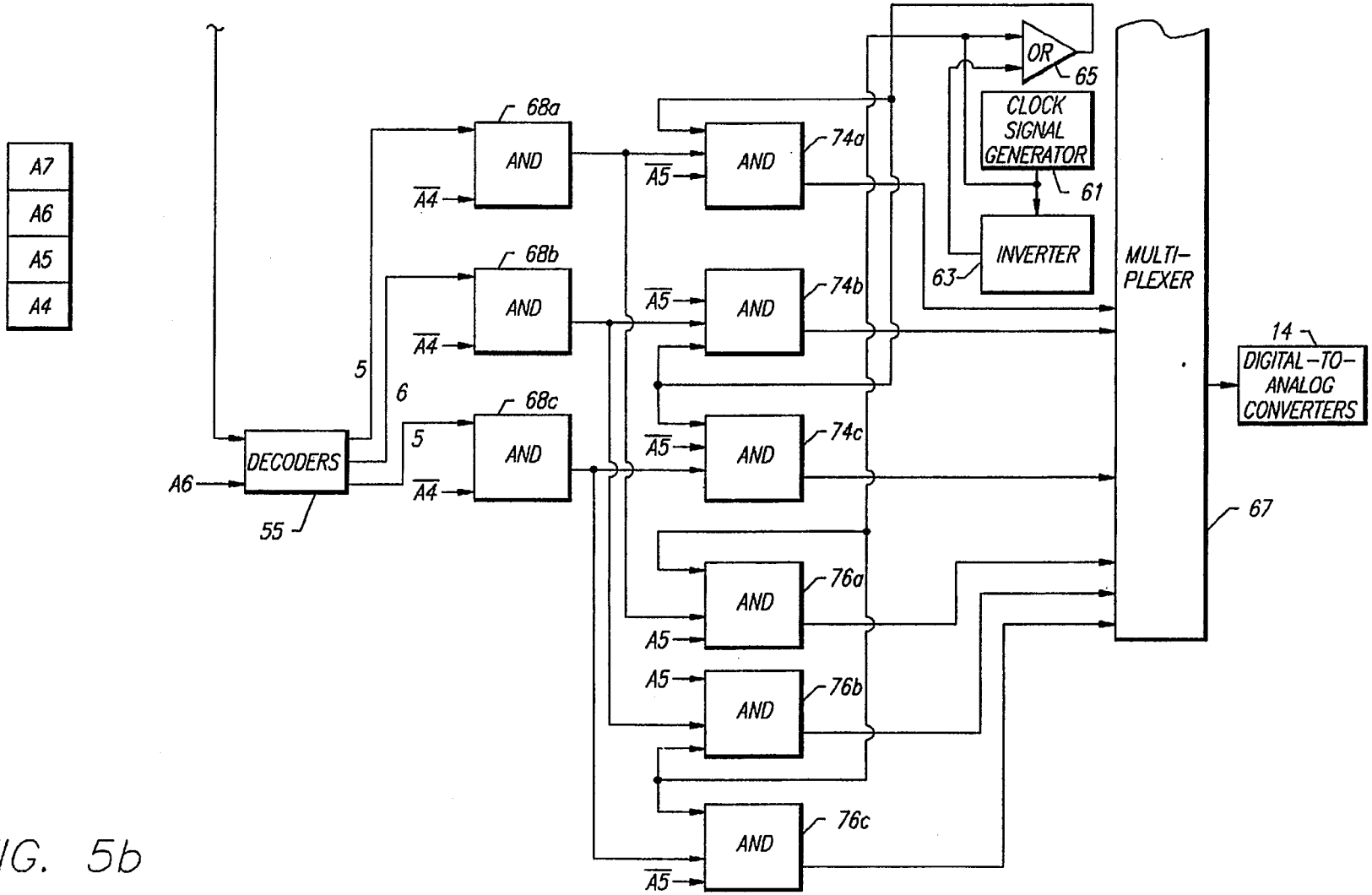
Figure 6:
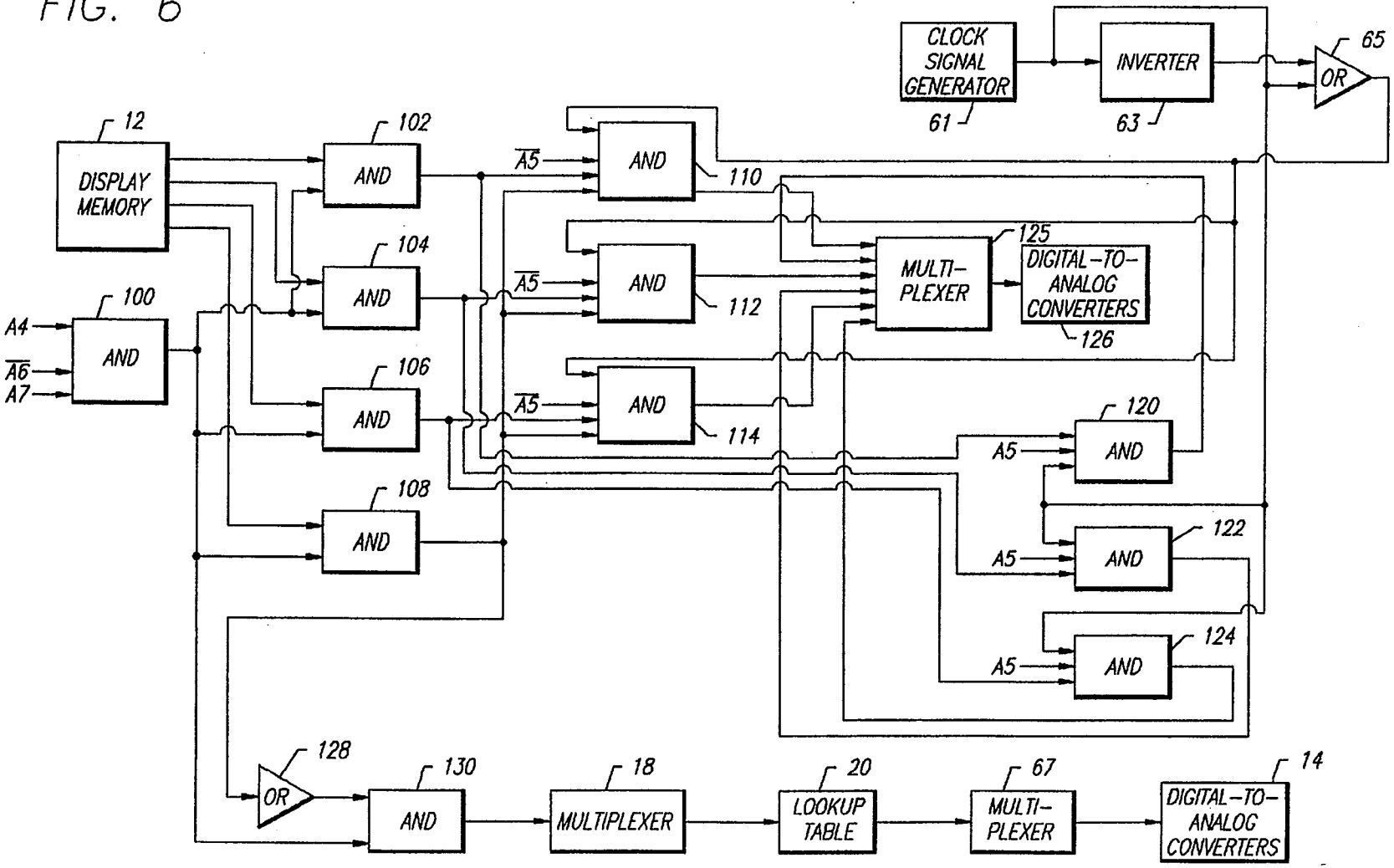

FIGS. 4*a* and 4*b* show wave forms of a clock signal and schematically illustrates the modes of processing signals in successive cycles or successive half cycles of the clock signal;

FIGS. 5*a* and 5*b* provide a simplified block diagram of sub-systems included in this invention for operating in patterns previously known in the prior art;

FIG. 6 is a simplified block diagram of sub-systems included in this invention and individual to this invention for operating in patterns individual to this invention;

FIG. 7 is a simplified block diagram of additional sub-systems included in this invention and individual to this invention for operating in patterns individual to this invention; and FIG. 8 is a simplified block diagram illustrating another mode of operation of this invention.

Figure 1:
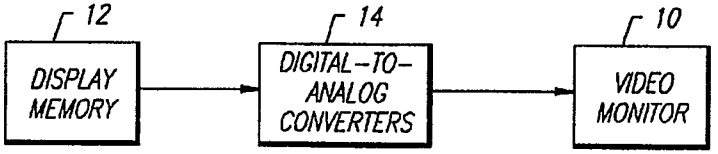
FIG. 1 PRIOR ART
FIG. 1 is a schematic diagram in block form of a system of the prior art for providing a presentation on a video monitor of an image in true colors.

A system well known in the prior art is shown in simplified block diagram in FIG. 1 for displaying true colors on a video monitor 10 in a work station or personal computer. The video monitor 10 may be constructed in a conventional manner to provide a raster scan of a plurality of pixels and to provide a color image in accordance with such raster scan. The color information for the successive pixels in the raster scan is provided by a display memory 12 which may be constructed in a conventional manner to store binary indications of the three (3) primary colors red, green and blue for each successive pixel in the raster scan.

The display memory 12 presents the binary indications for each successive pixel at a clock rate corresponding to the clock rate at which the pixels are presented at the video monitor 10. For example, this clock rate may be at a frequency of approximately fifty megahertz (50 Mhz). The number of binary indications for each of the primary colors in each pixel may be any suitable value but, in a constructed embodiment of the invention, eight (8) binary indications have been provided to represent each primary color. The binary indications from the display memory are converted by digital-to-analog converters 14 to corresponding analog signals. These analog signals are introduced to the video monitor 10 to provide a color image in true colors on the video monitor 10.

Figure 2:
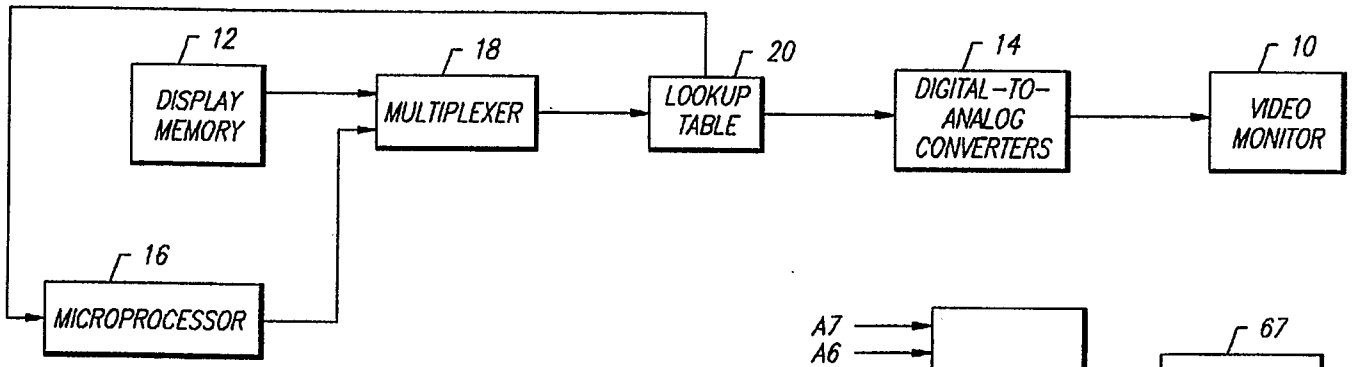
FIG. 2 PRIOR ART
FIG. 2 is a schematic diagram in block form of a system of the prior art for providing a presentation on a video monitor of an image in pseudo colors.

FIG. 2 indicates in a simplified block diagram a subsystem well known in the art for producing an image in pseudo colors on the video monitor 10. The sub-system shown in FIG. 2 also includes the display memory 12 and the analog-to-digital converters 14. The sub-system shown in FIG. 2 also includes a microprocessor 16 which introduces binary signals through a multiplexer 18 to a lookup table 20. The binary indications from the display memory 12 are also introduced through the multiplexer 18 to the lookup table 20. The output from the lookup table is introduced to the digital-to-analog converters 14. The analog signals from the converters 14 pass to the video monitor 10 as in FIG. 1.

The lookup table 20 is well known in the art. The lookup table 20 actually constitutes a memory for storing binary indications representing the primary colors red, green and blue. The lookup table 20 has a number of different positions controlled by the number of binary indications introduced at any instant from the display memory 12. For example, when the number of binary indications introduced at any instant from the display memory 12 is eight (8), two hundred and fifty six (256) positions may be provided in the lookup table 20. At each of these positions, binary indications of the three (3) primary colors may be stored to represent an individual color. Since the stored indications at each position in the lookup table 20 only approximate the true color for a pixel position in a color image, the stored indications represent a pseudo color.

The binary indications in the display memory 12 code for the individual positions in the lookup table 20. When a particular position in the lookup table 20 is selected at any instant by the indications at that instant from the display memory 12, the binary indications at this particular position in the lookup table are converted by the converters 14 to analog signals representing the primary colors. These primary colors are directed to a particular pixel on the video monitor 10 to produce a resultant color at such pixel position.

The binary indications at each position in the lookup table 20 may be updated at any time by binary indications from the microprocessor 16. These binary indications pass through the multiplexer 18 to the lookup table 20 under instructions to the multiplexer from the microprocessor 16. The microprocessor 16 first addresses the particular position in the lookup table 20 and then replaces the binary indications at this particular position with updated binary indications to represent an updated color.

The binary indications from the microprocessor 16 pass through the multiplexer 18 at any instant in accordance with instructions from the microprocessor and pre-empt the indications being presented at that time from the display memory 12. In this way, the multiplexer 18 operates to insure that the microprocessor 16 will have priority over the display memory 12 so that the desired color information from the microprocessor can be updated at selected positions in the lookup table. To assure that the desired information has been recorded in the lookup table 20 from the microprocessor 16 at the proper position in the lookup table, the information recorded in the lookup table from the microprocessor can be read and checked by the microprocessor.

FIG. 4(*a*) shows clock signals 24 each having alternate polarities in successive half cycles. When the frequency of the clock signals 24 is fifty megahertz (50 Mhz), each clock cycle may have a duration of twenty nanoseconds (20 ns). In one mode of operation, each byte of binary indications (e.g. 8) may be processed at a particular time in each clock cycle such as at the leading edge of the positive-going half cycle. This is indicated by arrows designated by the numeral 26 in FIG. 4(*b*). It is also indicated by the numeral "8" at the positive rising edges of the clock signals in FIG. 4(*a*).

In another mode of operation, each byte of binary indications (e.g. 8) may be processed at a particular time in each half cycle of each clock signal such as at the leading edges of the positive-going and negative-going half cycles. This is indicated at 28 and 30 in FIG. 4(*b*). It is also indicated by the numeral "8" in FIG. 4(*b*) above each change in polarity of the clock signal. The modes of operation discussed in this paragraph are well known in the prior art.

Successive pairs of bytes (each of eight (8) bits) may be processed to produce binary indications representing the three (3) primary colors. In one mode, the successive pairs of bytes may be processed in a five (5), five (5) and five (5) configuration. In this configuration, one of the bits in the successive pair of bytes is not used. Preferably this is the last bit in the second byte in the pair. As will be seen, each of the primary colors is represented by five (5) binary bits. In this way, a selection may be made from a total of almost thirty four thousand $(2^5)^3$ colors. All of these colors represent true colors. As will be appreciated, one of the three primary colors is obtained from the first byte, another of the primary colors is obtained from the second byte and the third primary color is obtained partially from the first byte and partially from the second byte. The processing of two (2) successive bytes, each having eight (8) binary indications, in a 5,5,5 pattern has been previously provided in the prior art.

In another mode of operation, successive pairs of bytes of binary indications may be processed to produce binary indications representing the three (3) binary colors in a five (5), six (6) and five (5) configuration. In this mode, all of the binary indications in each pair of two (2) successive bytes are processed. The binary indications for one of the primary colors may be obtained from the first byte and the binary indications for another of the primary colors may be obtained from the second byte. The binary indications for the third primary color may be obtained on a symmetrical basis from the last three (3) bits of the first byte and from the first three (3) bits of the second byte. In this pattern, all of the bits in each successive pair of two (2) bytes is used.

The binary indications representing the three (3) primary colors for each pixel in a 5,6,5 pattern may provide a true color. The number of colors capable of being selected for each pixel is twice as great as the number specified in a previous paragraph for a 5,5,5 pattern since an additional binary bit is being processed. The processing of two (2) successive binary bytes, each byte having eight (8) binary bits, in a 5,6,5 pattern has been previously provided in the prior art.

FIG. 3 shows the patterns in a register generally indicated at 32 for providing the different modes of operation discussed above. The register may be formed from a plurality (e.g. 4) of flip-flops each capable of providing a binary indication of a "1" or a "0". Different patterns of settings in the flip-flops in the register control the operation of the system in the different modes discussed above. These flip-flops are respectively designated as A4, A5, A6 and A7 in FIG. 3. As will be seen, the modes discussed above are shown in the first five (5) rows in FIG. 3. The next two (2) rows indicate modes of operation individual to the system of this invention. These individual modes will be discussed subsequently. The last row in FIG. 3 indicates another mode of operation well known in the art.

As will be seen in FIG. 3, a binary "0" in the flip-flop A4 indicates an operation of the system of this invention in one of the modes known in the prior art and described above. A binary "1" in the flip-flop A4 for the sixth (6th) and seventh rows provides for the selection of one of the modes individual to the system of this invention. A binary "0" in the flip-flop A7 for the first (1st) row provides for the selection of the system shown in FIG. 2 (including the lookup table 20) to obtain pseudo colors for display at the different pixels on the video monitor 10. When a binary "1" is produced in the flip-flop A7 for the first five (5) rows, real colors are displayed at the different pixels on the video monitor 10 with one exception. This exception will be discussed in detail subsequently.

When the system of this invention is operating in one of the real color modes previously known in the art (the rows 2–5 of FIG. 3) and the flip-flop A6 indicates a binary "0", the system operates to provide a 5,5,5 pattern for the three (3) primary colors from two (2) successive bytes of eight (8) binary indications. A binary "1" in the flip-flop A6 under such circumstances indicates that the system operates in a 5,6,5 pattern for the three (3) primary colors from two (2) successive bytes of eight (8) binary indications. As previously described, the operation of the system of this invention in a 5,5,5 pattern or in a 5,6,5 pattern provides true colors to the video monitor 10.

The flip-flop A5 controls whether the system will operate in a single edge mode involving the processing of a byte of eight (8) binary indications only once in each clock signal (as indicated in FIG. 4*a*) or will operate in a dual edge mode involving the processing of a byte of eight (8) binary indications once in each half cycle of each clock signal (as indicated in FIG. 4*b*). This is true of all of the modes shown in FIG. 4 except for the mode shown in the first row where pseudo colors are provided. A binary "1" in the flip-flop A5 indicates an operation of the system in the single edge mode in rows 2–8 and a binary "0" in the flip-flop A5 indicates an operation of the system in the double edge mode in rows 2–8.

FIGS. 5*a*–5*b* illustrate in a simplified block diagram the system described above as being known in the prior art. The system shown in FIG. 5 includes the flip-flops A4–A7. When the flip-flop A7 produces an $\overline{A7}$ signal, the binary indications from the display memory 12 pass through AND networks 50 (only one AND network being shown in representation) and the multiplexer 18 to the lookup table 20 to select a position in the lookup table. The binary indications at the selected position in the lookup table 20 are converted to analog signals as at 14. The analog signals produce individual colors at the successive positions on the video monitor 10. These individual colors are pseudo colors.

It will be appreciated to a person of ordinary skill in the art that an AND network corresponding to the AND network 50 has to be provided for each binary bit in a byte from the display memory 12 when the bits in each byte are presented in parallel. Only the AND network 50 is shown in FIGS. 5*a* and 5*b* for purposes of simplification. Similarly, digital-to-analog converters have to be provided for each primary color. Only the converters 14 are shown in FIG. 5 for purposes of simplification. The same logic applies to other stages shown in FIGS. 5, 6, 7 and 8.

When the flip-flop A7 produce an A7 signal, the binary indications from the display memory 12 pass through AND networks 52 (only one being shown in representation) in FIG. 5*a*. The binary indications in successive pairs of bytes from the display memory 12 are then decoded by decoders 53 to produce binary indications in a 5,5,5 pattern. These binary indications are indicated by three output lines from the decoders 53 with the numerals "5", "5" and "5" adjacent these lines. Similarly, when the flip-flop A6 produces an $\overline{A6}$ signal, the binary indications in successive pairs of bytes from the display memory 12 are decoded by decoders 55 in FIG. 5*b* to produce binary indications in a 5, 6, 5 configuration. These binary indications are indicated in FIG. 5*b* by three output lines from the decoders 55 with the numerals "5", "6" and "5".

The binary indications from the decoders 53 in FIG. 5*a* are introduced to AND networks schematically shown as AND networks 56*a*, 56*b* and 56*c*. Each of the AND networks 56*a*, 56*b* and 56*c* provides an indication of an individual one of the three (3) primary colors. The AND networks 56*a*, 56*b* and 56*c* also receive $\overline{A4}$ signals from the flip-flop A4 to provide for the passage of signals in successive pairs of bytes in the 5,5,5 pattern. These signals then pass through AND networks 60*a*, 60*b* and 60*c* when the flip-flop A5 produces a signal $\overline{A5}$ to indicate the operation of the system in a dual-edge mode as indicated in FIG. 4*b*.

In the dual-edge mode, signals from a clock signal generator 61 are introduced to an OR network 65. The clock signals from the generator 61 are inverted by an inverter 63 and the signals from the inverter are also introduced to the OR network 65. The signals from the OR network 65 then occur in the successive half cycles of the clock signals from the generator 61. This causes the signals from the AND networks 56*a*, 56*b* and 56*c* respectively to pass through the AND networks 60*a*, 60*b* and 60*c* in the successive half cycles of the clock signals. The signals then pass from the AND networks 60*a*, 60*b* and 60*c* to a multiplexer 67 in the successive half cycles of the clock signals and from the multiplexer 62 to the digital-to-analog converters 14. The multiplexer 67 may be constructed in a manner well known in the art.

The signals in the 5,5,5 configuration from the AND networks 56*a*, 56*b* and 56*c* in FIG. 5*a* also respectively pass to AND networks 66*a*, 66*b* and 66*c*. The decoded signals in the 5,5,5 configuration then pass through the AND networks 66*a*, 66*b* and 66*c* when the flip-flop A5 is in the A5 state. The flip-flop A5 is in the A5 state when the system operates in the single mode as illustrated in FIG. 4*a*. In the single mode, only the signals from the clock signal generator 61 (and not from the OR network 65) are introduced to the AND networks 66*a*, 66*b* and 66*c*. The signals passing through the AND networks 66*a*, 66*b* and 66*c* are then passed through the multiplexer 67 and are introduced to the digital-to-analog converter 14.

In like manner, the signals from the decoders 55 in the 5,6,5 configuration in FIG. 5*b* pass through AND networks 68*a*, 68*b* and 68*c* when the flip-flop A4 is in the $\overline{A4}$ state. This occurs when the system of this invention is operating in one of the modes previously known in the art as distinguished from one of the modes individual to this invention. Each of the AND networks 68*a*, 68*b* and 68*c* provides an indication of an individual one of the primary colors.

The decoded signals in the 5,6,5 pattern from the AND networks 68*a*, 68*b* and 68*c* then pass through AND networks 74*a*, 74*b* and 74*c* in successive half cycles of the clock signals when the flip-flop A5 is in the $\overline{A5}$ state to obtain the dual-edge mode of operation as indicated in FIG. 4*b*. This occurs in accordance with the introduction of signals to the AND networks 74*a*, 74*b* and 74*c* from the OR network 65 (also shown in FIG. 5*a*). The decoded signals passing through the AND networks 74*a*, 74*b* and 74*c* pass through the multiplexer 67 to the digital-to-analog converters 14.

The decoded signals in the 5,6,5 pattern from the AND networks 68*a*, 68*b* and 68*c* pass through AND networks 76*a*, 76*b* and 76*c* when the flip-flop A5 is in the A5 state to indicate a single-edge mode of operation as shown in FIG. 4*a*. This occurs because only signals from the clock signal generator 61 (and not from the OR network 65) are introduced to the AND networks 76*a*, 76*b* and 76*c*. The signals passing through the AND networks 76*a*, 76*b* and 76*c* are decoded by the decoders 62.

The sixth (6th) and seventh (7th) rows in FIG. 3 indicate the register controls for the additional modes of operation individual to this invention. A binary "1" in the flip-flop A4 indicates that one of the modes individual to this invention is to be performed. For example, the binary indications 1001 in the sixth row provide the settings respectively in the flip-flops A4, A5, A6 and A7 to obtain the conversion of successive bytes, each having a particular number (e.g. 8) of binary indications, into an individual pattern of converting binary indications of primary colors to analog values.

In the conversion when the flip-flops A4–A7 have binary indications of 1001, the bytes of binary indications are disposed in successive groups of four (4) bytes. Three (3) of the bytes in each group provide an indication of the individual ones of the primary colors red, green and blue. These bytes may preferably constitute the first three (3) bytes or they may constitute the last three (3) bytes in the group or any three (3) of the four (4) bytes in a group. These three (3) bytes represent true colors.

FIG. 6 indicates the three (3) primary colors as being indicated in the first three (3) bytes of each group. However, the indications in the first three (3) bytes in each group are not converted to corresponding analog signals unless the other byte in the group has a particular value such as a value of 0 for each of the binary indications in the byte. This is represented by a binary value of "0" for each of the eight (8) binary bits in the fourth (4th) byte in the group.

FIG. 6 schematically represents a sub-system included in this invention for producing one of the modes of operation individual to this invention. The sub-system includes the display memory 12 and an AND network 100 which passes a signal when the flip-flops A4, A6 and A7 have a binary pattern of 101. When the AND network 100 becomes activated, AND networks 102, 104 and 106 respectively pass individual ones of the first three (3) bytes in a group of four (4) bytes to individual ones of AND networks 110, 112 and 114.

When an AND network 108 becomes activated, the AND network 108 receives the eight (8) binary indications in the fourth (4th) byte and passes an activating signal to the AND networks 110, 112 and 114 when all of the binary indications in the fourth (4th) byte in a group are a binary "0". The binary indications introduced to each of the AND networks 110, 112 and 114 then pass through the AND networks in the dual-edge mode (as indicated in FIG. 4*b*) when the flip-flop A5 is in the $\overline{A5}$ state. In the dual-edge mode, signals from the OR network 65 (also shown in FIGS. 5*a* and 5*b*) are introduced to the AND networks 110, 112 and 114 in the successive half cycles of the clock frequency from the clock signal generator 61. The signals may be presented at a frequency of approximately 66.7 megacycles. Since there are eight (8) binary indications in each of the three (3) primary colors, more than sixteen million (16M) different colors may be indicated in a true color format in the mode shown in FIG. 6 and described above.

For a binary pattern of 1001 in the flip-flops A4–A7, the colors represented by three (3) of the four (4) bytes in each group may also be presented in a single-edge mode (as indicated in FIG. 4*a*) where each of the three (3) primary colors may be processed at the rising edges of three (3) successive clock signals. For a primary frequency of one hundred megahertz (100 Mhz) for the clock signals, this corresponds to a frequency of presentation of approximately 33.3 Mhz for each pixel. The binary indications in the first three (3) bytes in each group are converted to true colors only when the fourth (4th) byte in such group represents an analog value of "0".

The binary indications from the AND networks 102, 104 and 106 may also be presented to AND networks 120, 122 and 124 in FIG. 6. These indications then pass through the AND networks 120, 122 and 124 in the single edge mode. This occurs in accordance with the introduction of signals from the clock signal generator 61 (and not from the OR network 65) to the AND networks 120, 122 and 124. The indications are then passed through the multiplexer 67 to the digital-to-analog converters 14. This occurs at a frequency of approximately 33.3 megahertz.

When the fourth (4th) byte in each group has a value different from 0, the binary indications in the first three (3) bytes in a group are prevented by the AND network 108 from passing through the AND networks 110, 112 and 114. This may be seen from the action of the AND network 108 in blocking the passage of signals through the AND networks 110, 112 and 114. Instead, the binary indications in the fourth (4th) byte in each group are passed from the display memory 12 through an OR network 128 which is activated only when at least one of the binary indications in the fourth (4th) byte has a binary value of 1. Although only one line is shown as being connected from the AND network 108 to the input to the OR network 128, it will be appreciated that eight (8) lines are connected to the OR network, one (1) line for each individual one of the eight (8) binary bits.

The binary indications passing through the OR network 128 then pass to an AND network 130 which receives the indications in the fourth (4th) byte in each group. The indications pass through the AND network 130 when a signal passes through the OR network 128 to indicate a binary value other than 0 for the indications in the fourth byte in each group and when the flip-flops A4, A6 and A7 have a binary pattern of 101.

The indications from the AND network 130 pass through the multiplexer 18 to the lookup table 20. These binary indications provide for the selection of a particular one of the positions in the lookup table 20 in accordance with the value different from 0, indicated in the fourth (4th) byte in each group. The binary indications in the selected position in the lookup table 20 then pass through the multiplexer 67 to the digital-to-analog converters 14. Color representations are then provided at the different pixel positions in accordance with the analog signals representing the binary indications at the selected positions in the lookup table for such positions. This occurs at a frequency of approximately twenty five megahertz (25 Mhz).

As previously described, the system of FIG. 6 operates with a pattern of 1011 in the flip-flops A7–A4 to produce true color indications, each of eight (8) binary bits, of the primary colors red, green and blue in a single edge mode. However, the system provides the primary colors in only three of the four (4) bytes since the fourth (4th) byte provides information for the look-up table in one mode or provides a control indication to obtain the colors.

The mode shown in FIG. 6 and described above has certain important advantages. It provides for true colors with greater resolution than is provided by the different modes in the prior art. This is because each of the primary colors is represented by eight (8) binary bits. Furthermore, since true colors and pseudo colors can be provided in the same mode, some of the pixels in a frame can be in true color and other pixels in the frame can be in pseudo color. This allows all of an image except a window to be in true color and the window to be in pseudo color. An alternate arrangement can also be provided in which most of the image in a frame is in pseudo color and a window is in true color.

The embodiment shown in FIG. 6 can be modified in accordance with the embodiment shown in FIG. 7. In FIG. 7, some of the different positions in the lookup table 20 are blocked from being activated by the fourth (4th) byte of binary indications in each group. This may illustratively occur when it may be desired to exclude positions in the lookup table 20 with a predominantly blue color. The indications in the selected positions may be excluded by disposing AND networks 130*a*, 130*b*, etc. between the lookup table 20 and the multiplexer 67. Each of the AND networks 130*a*, 130*b*, etc. receives signals from an individual position in the lookup table 20 at a first input terminal. When, for example, the AND network 130*a* provides a binary 1 at a second input terminal, the binary indications pass through the AND network 130*a* to the multiplexer 67 to obtain the decoding of the binary indications at this position. However, when the indication in the AND network 130*a* is a binary 0, the binary indications cannot be introduced to the multiplexer 67. Alternatively, AND networks such as the AND networks 130*a*, 130*b*, etc. may be disposed between the multiplexer 18 and the lookup table 20 in FIG. 2.

When the registers A7–A4 have a binary pattern of 111, the system operates in three successive bytes, each of eight (8) bits, to provide the three (3) primary colors red, green and blue. The system then provides the three (3) primary colors again in the next three (3) bytes each of eight (8) bits. This system is advantageous over the system represented by the sixth (6th) row of FIG. 3 because it can operate at an increased frequency relative to the system discussed in the previous paragraph. The system operates in the single edge mode.

The system operative in the pattern of 1111 for the registers A7–A4 is shown in FIG. 8. In this arrangement, an AND network 150 receives the A7–A4 indications, the indications from the display memory 12 and the indications from the OR network 65 and introduces the indications from the display memory 12 to the multiplexer 67. The multiplexer 67 then passes the indications to the digital-to-analog converter 14 which converts the binary indications to analog information for display on the video monitor 10 in FIG. 1.

The systems shown in the drawings and described above have been presented on a simplified basis. It will be appreciated, however, that all of the different networks shown in the drawings and described above may be synchronized to operate on the rising edge of each clock signal in the case of a single mode system and to operate on the rising and falling edges of each clock signal in the case of a dual mode system.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for displaying information on a video monitor, first means for providing successive groups of four (4) bytes of information, three (3) of the four (4) bytes in each group representing individual ones of the primary colors red, green and blue, second means responsive to first indications in the fourth (4th) byte of information in each group for providing for a selection of the three (3) bytes of information to represent a true color for display on the video monitor, a lookup table having a plurality of positions for storing indications representing individual colors in the different positions, fourth means responsive to second indications, different from the first indications, in the fourth (4th) byte of information in each group for providing for the selection of the individual indications of the primary colors red, green and blue from the different positions in the lookup table in accordance with such second indications, and fifth means operatively coupled to the third means and the fourth means for providing for a conversion of the the three (3) bytes of information in each group from the first means to signals for introduction to the video monitor to represent the primary colors red, green and blue upon the occurrence of the first indication in the fourth byte of information and for providing for a conversion to signals for introduction to the video monitor of the primary colors red, green and blue from the different positions in the lookup table upon the occurrence of the second indications in the fourth (4th) byte of information in such group.

2. In a combination as set forth in claim 1 wherein the three (3) bytes of information and the fourth byte of information in each group are in binary form and the individual indications at the different positions in the lookup table are in binary form and the fifth means converts the three (3) bytes of information in each group and the individual indications at the different positions in the lookup table to an analog form in accordance with the selection of the three (3) bytes of information or the fourth (4th) byte of information in such group.

3. In a combination as set forth in claim 2, means for updating the individual indications of the primary colors red, green and blue at the different positions in the lookup table.

4. In a combination as set forth in claim 3, means for preventing the indications at particular positions in the lookup table from being converted by the fifth means to analog representations of the primary colors red, green and blue stored at such particular positions.

5. In combination for displaying information at different pixel positions on a video monitor, first means for providing sequences of binary bytes of indications, first, second and third binary bytes of indications in each sequence respectively representing the primary colors and the fourth binary byte of indications in each sequence providing for the conversion of the first, second and third binary bytes of indications in that sequence directly to a color for display on the video monitor at an individual one of the pixel positions upon the occurrence of a first indication in such fourth binary byte and the fourth byte of indications in each sequence providing for the display of a pseudo color on the video monitor at such individual pixel position upon the occurrence of second indications in such binary byte other than the first indications, a lookup table having a plurality of positions for storing individual indications of pseudo colors at different positions in the lookup table, second means for converting binary bytes of indications to analog signals for introduction to the video monitor to obtain a display of colors at the different pixel positions on the video monitor, third means responsive to the first indications in the fourth byte of indications in each sequence for introducing the indications in the first, second and third bytes in that sequence to the second means for conversion to analog signals for introduction to the video monitor, and fourth means responsive to the second indications in the fourth byte of indications in each sequence for introducing the fourth byte of indications in that sequence to the lookup table to obtain a selection of the indications in a particular position in the lookup table in accordance with such second indications, and fifth means for introducing the indications from the selected positions in the lookup table to the second means for conversion to analog signals for introduction to the video monitor.

6. In a combination as recited in claim 5, means for updating the information stored in particular positions in the lookup table.

7. In a combination as recited in claim 5, means for providing at a particular frequency clock signals having first and second half cycles, fifth means for providing for the introduction of the indications in the first, second and third bytes in each sequence to the second means in each of the successive half cycles of the clock signals for introduction to the video monitor, and sixth means for providing for the introduction of the indications in the first, second and third bytes in each sequence to the second means in successive half cycles of the clock signals for introduction to the video monitor.

8. In a combination as set forth in claim 5, means for providing clock signals at a particular frequency, and means for providing for the introduction of the fourth byte of indications in each sequence by the fourth means to the lookup table in alternate clock signals to obtain the selection of the indications in the particular position in the lookup table in accordance with such second indications.

9. In combination for displaying information on a video monitor, a plurality of registers, first means for providing successive bytes of information, second means responsive to first indications in the registers for converting indications from successive pairs of bytes of information to indications of the three primary colors, third means for providing at a particular frequency clock signals having successive half cycles, fourth means responsive to second indications in the registers for providing for the conversion of the indications by the second means in the successive half cycles of the clock signals, fifth means responsive to third indications in the registers for providing for the conversion of the indications by the second means in the successive cycles of the clock signals, sixth means responsive to fourth indications in the registers for providing successive sequences of four (4) bytes, seventh means responsive to the successive sequences of four bytes for converting three of the four (4) bytes of information in each sequence to indications of the three (3) primary colors upon the occurrence of particular indications in the fourth byte of information in such sequence, a lookup table have a plurality of positions for storing individual indications of color in the different positions, eighth means responsive to the successive sequences of four (4) bytes and to the indications in the fourth byte of each sequence other than the particular indications for obtaining the transfer of the individual indications from the different positions in the lookup table in accordance with the indications in the fourth byte in such sequence, and ninth means responsive to the indications from the second and seventh means and from the lookup table for obtaining the conversion of such indications to analog indications of the primary colors for introduction to the video monitor.

10. In a combination as set forth in claim 9, each of the bytes having 8 binary bits of information, tenth means responsive to fifth indications in the registers for providing a 5,6,5 conversion of the binary bits in the successive pairs of bytes to the three primary colors, and eleventh means responsive to sixth indications in the registers for providing a 5,5,5 conversion of the binary bits in the successive pairs of bytes to the three primary colors.

11. In a combination as set forth in claim 9, tenth means responsive to the individual indications from the different positions in the lookup table for blocking the indications from particular positions in the lookup table from being converted by the ninth means.

12. In a combination as set forth in claim 9, the video monitor providing frames of color indications to define a color image, the eighth means providing pseudo random colors in a portion of the frame of true colors.

13. In combination for displaying information on a video monitor, first means for providing successive bytes of information, each byte of information having eight binary (8) bits, a plurality of registers each constructed to store indications, second means responsive to first indications in the registers for providing a conversion of the binary bits in each pair of successive bytes into representations of the three primary colors in a five (5) six (6) and five (5) pattern in true color, third means responsive to second indications in the registers for providing a conversion of the binary bits in each pair of successive bytes into representations of the three (3) primary colors in a five (5), five (5) and five (5) pattern in true color, fourth means responsive to third indications in the registers for providing a conversion of the binary bits in each group of three (3) successive bytes into representations of the three (3) primary colors in an eight (8), eight (8) and eight (8) configuration upon the occurrence of particular indications in the binary bits in a fourth byte in such group, the fourth (4th) byte in each group being contiguous to the three (3) bytes in such group, a lookup table having a plurality of positions each constructed to store indications representing an individual combination of the three (3) primary colors in pseudo random color, and fifth means responsive to the third indications in the registers for providing a selection by the indications, other the particular indications, in the fourth (4th) byte in each group of an individual one of the positions in the lookup table, and sixth means responsive to the indications from the second means, the third means, the fourth means and the lookup table for providing a conversion of such indications to analog colors for introduction to the video monitor.

14. In a combination as set forth in claim 13, means for updating at individual positions in the lookup table the indications representing the individual combinations of the three (3) primary colors, and means for blocking the conversion by the sixth means of the indications from particular positions in the lookup table.

15. In a combination as set forth in claim 13, seventh means for providing at a particular frequency clock signals having successive half cycles, eighth means responsive to fourth indications from the registers for providing for the conversion by the second means, the third means and the fourth means in successive half cycles of the clock signals, and ninth means responsive to fifth indications from the registers for providing for the conversion by the second means, the third means and the fourth means in successive cycles of the clock signals.

16. In a combination as set forth in claim 15, means for updating at individual positions in the lookup table the indications representing the individual combinations of the three (3) primary colors, the video monitor providing frames of color indications to define a color image, the fifth means providing a portion of each frame in pseudo random colors and the remainder of such frame in true colors.

17. In combination for displaying color information on a video monitor, first means for providing successive byt of binary indications, the successive bytes being divided into groups, each group having bytes representing the binary colors and each group having an additional byte, second means responsive to first indications in the additional byte in each group for activating the bytes representing the three (3) primary colors, a lookup table having a plurality of different positions for storing individual indications of the primary colors at the different positions in the lookup table, third means responsive to indications in the additional byte in each group other than the first indications in the additional byte in such group for activating one of the different positions in the lookup table in accordance with the indications in such additional byte, and fourth means responsive to the binary indications in the activated bytes representing the primary colors and the binary indication in the activated positions in the lookup table for converting such binary indications to analog signals for introduction to the video monitor.

18. In a combination as set forth in claim 17, means for replacing the indications of color at individual positions in the lookup table with new indications of color at such individual positions.

19. In a combination as set forth in claim 18, means for preventing the indications in particular positions in the lookup table from being converted by the fourth means to analog signals for introduction to the video monitor.

20. In a combination as set forth in claim 17, means for providing at a particular frequency clock signals having successive half cycles, means for providing for the introduction to the first means, in the successive cycles of the clock signals, of the bytes representing the primary colors in each group, and means for providing for the introduction to the first means, in the successive half cycles of the clock signals, of the bytes representing the primary colors in each group.

21. In combination for displaying information on a video monitor at the different pixel positions in the video monitor, first means for providing a plurality of bytes of binary indications, the bytes being disposed in successive groups, each group having a plurality of bytes each representing one of the primary colors and there being an additional byte in each group, second means responsive to the binary indications in the bytes representing the primary colors in each group and responsive to first indications in the additional byte in each group for producing a display in the different pixels on the video monitor of the true color represented by such bytes, and third means responsive to the binary indications in the additional byte other than the first indications in the additional byte in each group for producing a display in the different pixels on the video monitor of a pseudo color in accordance with such indications in such additional byte.

22. In a combination as set forth in claim 21, fourth means for providing at a particular frequency clock signals having successive half cycles, control means having first and second control states, fifth means responsive to the first control state in the control means for providing for an operation of the second means, in the successive half cycles of the clock signals, in producing the display in the different pixels in the video monitor of the true color represented by the plurality of bytes in each group, and sixth means responsive to the second control state in the control means for providing for an operation of the second means, in the successive cycles of the clock signals, in producing the display in the different pixels in the video monitor of the true color represented by the plurality of bytes in each group.

23. In a combination as set forth in claim 21, means for providing an updating of the pseudo colors provided by the third means in accordance with the indications provided by the third means in each additional byte in each group.

24. In a combination as set forth in claim 21, means for blocking the operation of the third means in providing an indication for display on the video monitor of particular ones of the pseudo colors available to be displayed on the video monitor from the lookup table.

25. In a combination as set forth in claim 21, the color monitor being constructed to display a plurality of pixels in a frame, the second means and the third means being operative to display a portion of the image in a frame in true colors and the remaining portion of the image in the frame in pseudo colors.

26. In a combination as set forth in claim 22, means for providing an updating of the pseudo colors provided by the third means in accordance with the indication provided by the third means in each additional byte in each group, the color monitor being constructed to display a plurality of pixels in a frame, the second means and the third means being operative to display a portion of the image in a frame in true colors and the remaining portion of the image in the frame in pseudo colors.

* * * * *